US006854464B2

(12) United States Patent
Mukaiyama et al.

(10) Patent No.: US 6,854,464 B2
(45) Date of Patent: Feb. 15, 2005

(54) RESPIRATION PROTECTING APPARATUS

(75) Inventors: Etsuji Mukaiyama, Higashiosaka (JP); Nobutaka Takami, Higashiosaka (JP)

(73) Assignee: Yamamoto Kogaku Co., Ltd., Osaka (JP)

( * ) Notice: Subject to any disclaimer, the term of this patent is extended or adjusted under 35 U.S.C. 154(b) by 49 days.

(21) Appl. No.: 10/309,444

(22) Filed: Dec. 2, 2002

(65) Prior Publication Data

US 2004/0079373 A1 Apr. 29, 2004

(51) Int. Cl.[7] ..... A62B 18/08
(52) U.S. Cl. ..... 128/206.17; 128/205.27
(58) Field of Search ..... 128/200.27, 200.28, 128/201.25, 204.15, 205.22, 205.27, 206.17; 55/DIG. 33, DIG. 35

(56) References Cited

U.S. PATENT DOCUMENTS 908,108 A * 12/1908 Knudsen ..... 128/200.27
2,332,662 A * 10/1943 Nathanson ..... 128/200.27
2,333,054 A * 10/1943 Sullivan ..... 128/200.27
3,140,590 A * 7/1964 Gleockler ..... 62/259.3
3,535,707 A * 10/1970 Greenlee ..... 128/200.27
3,736,927 A * 6/1973 Misaqi ..... 128/201.25
4,127,122 A * 11/1978 Kienhofer et al. ..... 128/201.25
4,233,972 A * 11/1980 Hauff et al. ..... 128/205.12
4,331,141 A * 5/1982 Pokhis ..... 128/204.28
4,350,507 A * 9/1982 Greenough et al. ..... 73/863.23
4,502,480 A * 3/1985 Yamamoto ..... 128/201.15
4,549,541 A * 10/1985 Sundahl ..... 128/201.19
4,549,542 A * 10/1985 Chien ..... 128/201.24
4,590,951 A * 5/1986 O'Connor ..... 128/204.23
4,676,236 A * 6/1987 Piorkowski et al. ... 128/201.23
4,901,716 A * 2/1990 Stackhouse et al. ... 128/201.25
4,980,926 A * 12/1990 Noetzel ..... 398/117
5,003,974 A * 4/1991 Mou ..... 128/201.25
5,022,900 A * 6/1991 Bar-Yona et al. ..... 96/142
5,036,842 A * 8/1991 van der Smissen et al. ..... 128/204.18
5,046,492 A * 9/1991 Stackhouse et al. ... 128/200.27
5,154,168 A * 10/1992 Schlobohm ..... 128/205.27
5,394,870 A * 3/1995 Johansson ..... 128/205.22
5,526,805 A * 6/1996 Lutz et al. ..... 128/204.18
5,577,496 A * 11/1996 Blackwood et al. ... 128/201.25
6,349,724 B1 * 2/2002 Burton et al. ..... 128/204.18
6,705,314 B1 * 3/2004 O'Dea ..... 128/204.18

* cited by examiner

*Primary Examiner*—Aaron J. Lewis
(74) *Attorney, Agent, or Firm*—Koda & Androlia

(57) ABSTRACT

A respiratory protection apparatus has a face body, and a right side and a left side of a vertical centerline of the body are respectively provided with filtering devices each of which houses an electrical fan unit therein. Without narrowing the field of the front vision, without increasing the front side weight, and without deteriorating the work efficiency and comfortable fitting, the apparatus ensures the air flow rate of more than 120 liters per minute. Moreover, the electrical fan unit may be detachable from the face body, so that the face body is easily washed and parts are readily replaced with new ones.

4 Claims, 5 Drawing Sheets

RESPIRATION PROTECTING APPARATUS

TECHNICAL FIELD

The present invention relates to a respiratory protection apparatus usable as a dust mask or a gas mask in the place, such as a factory or a construction site, where dust or toxic gas is generated.

DESCRIPTION OF THE PRIOR ART

One type of conventional respiratory protection apparatus is shown in FIG. 4. It has a face body 31 covering at least a nose and a mouth of a wearer, an electrical fan unit 32 and a dust-prevention or gas-proof filtering device 33. The electrical fan unit 32 is attached to a central portion of the face body 31. The filtering device 33 is provided detachably on the front portion of the electrical fan unit 32.

Another type of conventional respiratory protection apparatus is shown in FIG. 5. It has a face body 31 covering at least a nose and a mouth of a wearer and respective filtering devices on both the left and right sides of the face body 31.

In the respiratory protection apparatus shown in FIG. 4, however, in order to guarantee the air flow rate of more than 120 liters pet minute which JIS (Japanese Industrial Standard) requires for a respiratory protection device with an electrical fan (JIST8157), the electrical fan unit 32 must be large enough to increase air flow. This results in narrowing of the field of front view, increasing the front side weight and deteriorating work efficiency and comfortable fitting. Furthermore, in this apparatus with the same filtering device 33, when air flow rate is increased, a filter gets clogged rapidly, air flow rate decreases, in the end, the filter must be replaced with a new one frequently.

Furthermore, in this apparatus with the face body 31 having the electrical fun unit 32 thereon, since the electrical fan unit 32 cannot be removed from the face body 31, it is difficult to do maintenance work such as cleaning and washing of the face body and replacement of parts.

The respiratory protection apparatus shown in FIG. 5 has filtering devices 33 on both sides of the face body 31, but no electrical fan unit. As a result, air cannot be forcibly flowed, and enough air flow rate cannot be guaranteed.

SUMMARY OF THE INVENTION

It is therefore an object of the present invention to provide a respiratory protection apparatus to overcome the problems the conventional respiratory protection apparatus has. Namely, it is an object of the present invention to provide a respiratory protection apparatus in which air flow rate of more than about 120 liters per minute (required by JIS for a respiratory protection device with an electrical fan (JIST8157)) is ensured, without narrowing the field of front view, without increasing the front side weight, and without deteriorating the work efficiency or comfortable fitting, moreover, the electrical fan unit may be removed from the face body, and maintenance work such as washing and cleaning of the face body with water and replacement of parts may be easily done.

In order to achieve the above objects a respiratory protection apparatus according to the present invention has a face body and filtering devices on a left and a right side portion of a vertical centerline of the body. Each filtering device is provided with an electrical fan unit.

The electrical fan unit of the respiratory protection apparatus according to the present invention is housed in the filtering device. The electrical fan unit and the filtering device are respectively provided detachably on the face body.

The respiratory protection apparatus according to the present invention may include a voice transmitter on an upper central portion of the face body and an exhaust valve on a lower central portion thereof.

The above and other objects and effects of the present invention will become apparent from the following description read in conjunction with the accompanying drawings.

DETAILED DESCRIPTION OF THE PREFERRED EMBODIMENT

Figure 1:
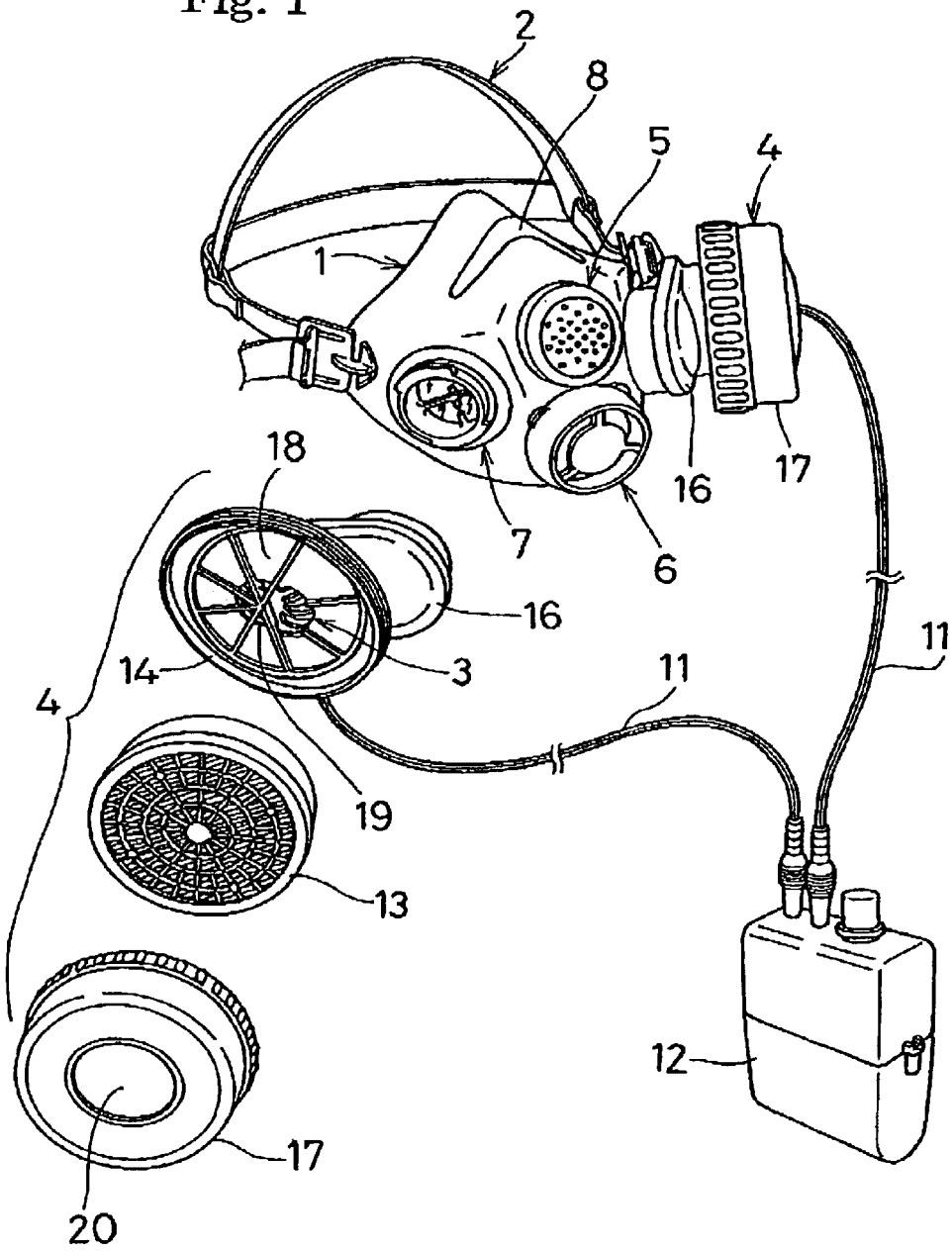
FIG. 1 is a view showing a state in which one of the filtering devices is detached from the face body of the respiratory protection apparatus according to the present invention and then disassembled.
Figure 2:
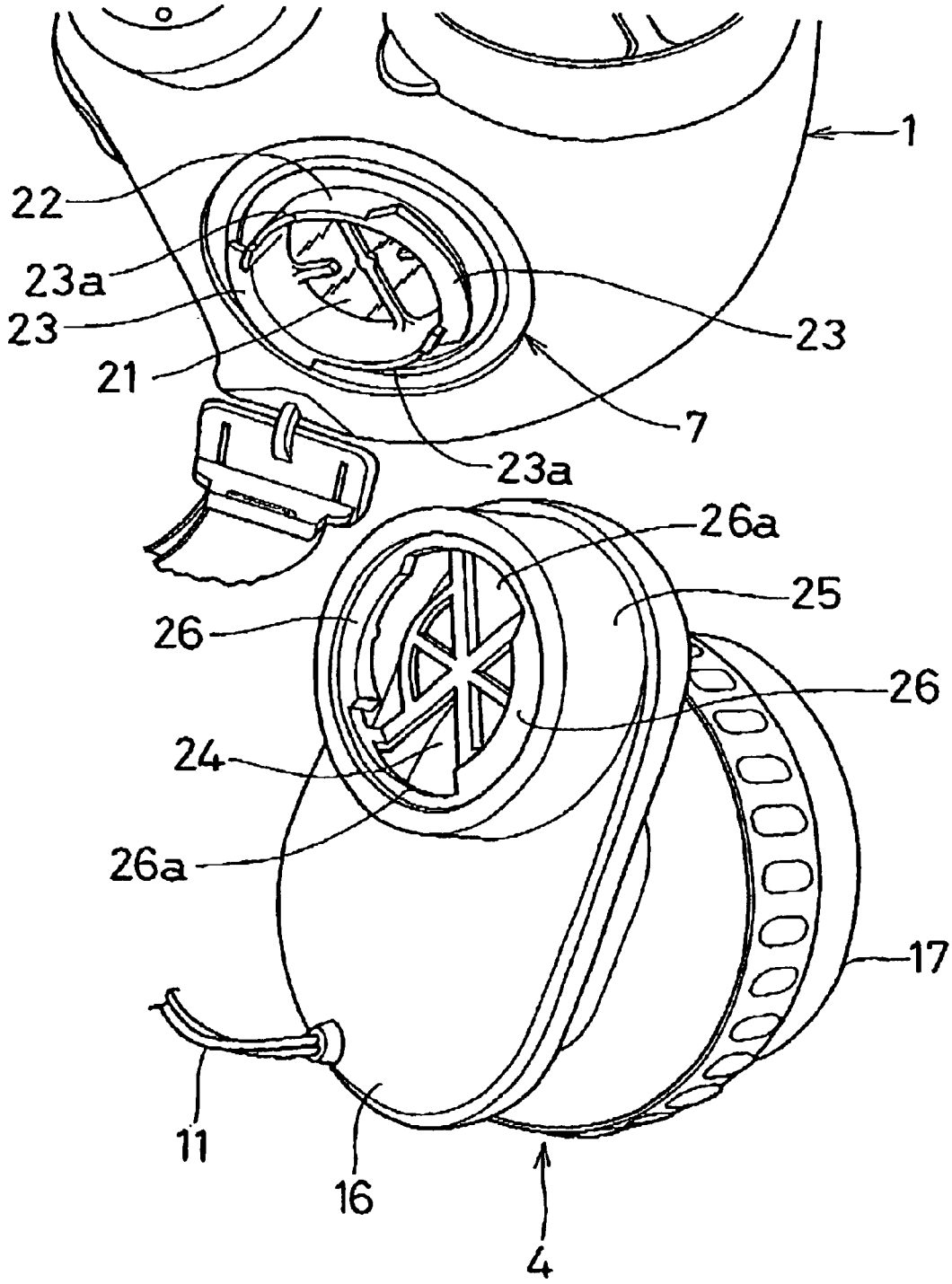
FIG. 2 is an enlarged view of essential parts showing a state in which the filtering device is detached from the face body of the respiratory protection apparatus according to the present invention.
Figure 3:
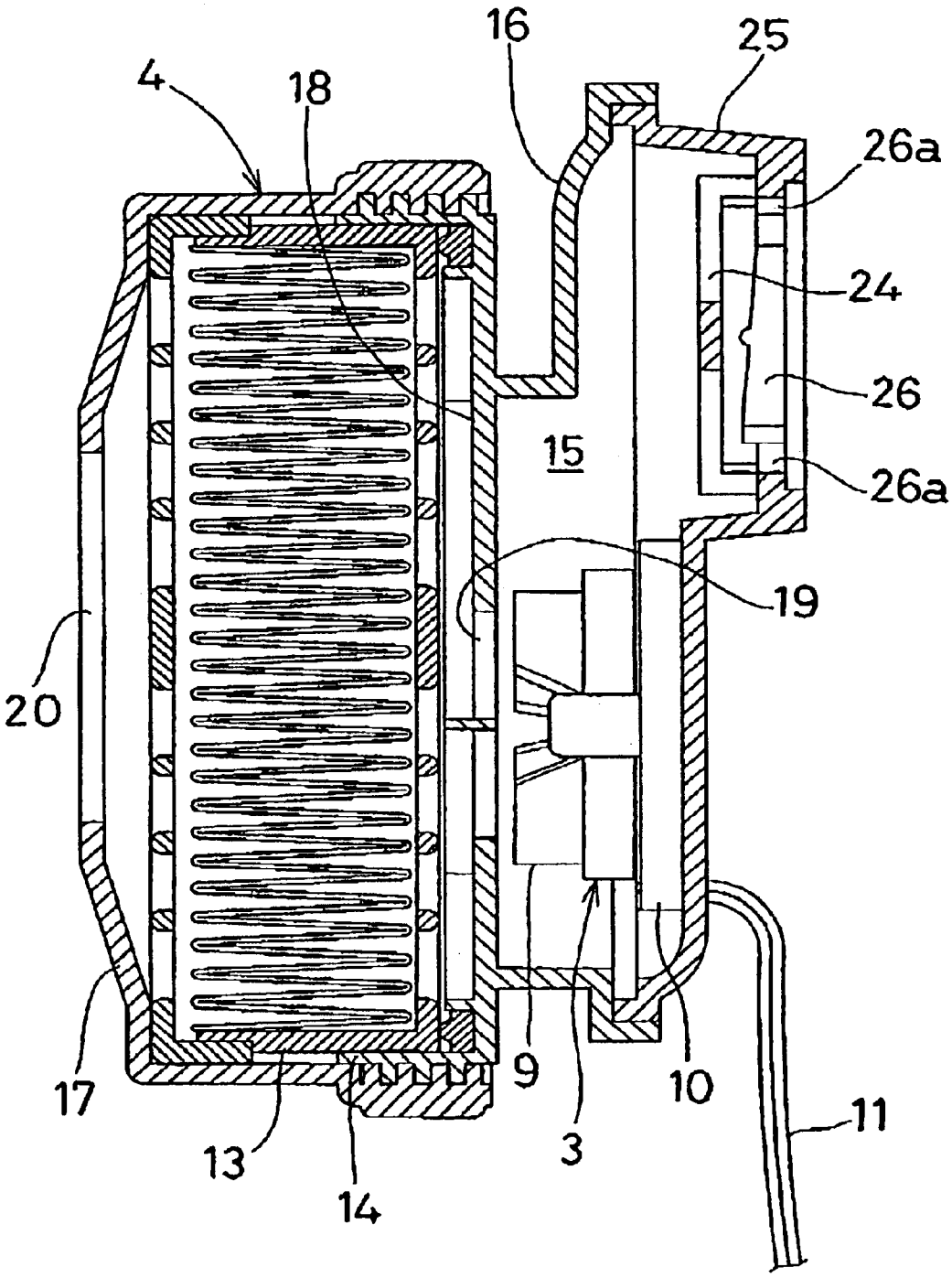
FIG. 3 is a sectional view of the filtering device of the respiratory protection apparatus according to the present invention.
Figure 4:
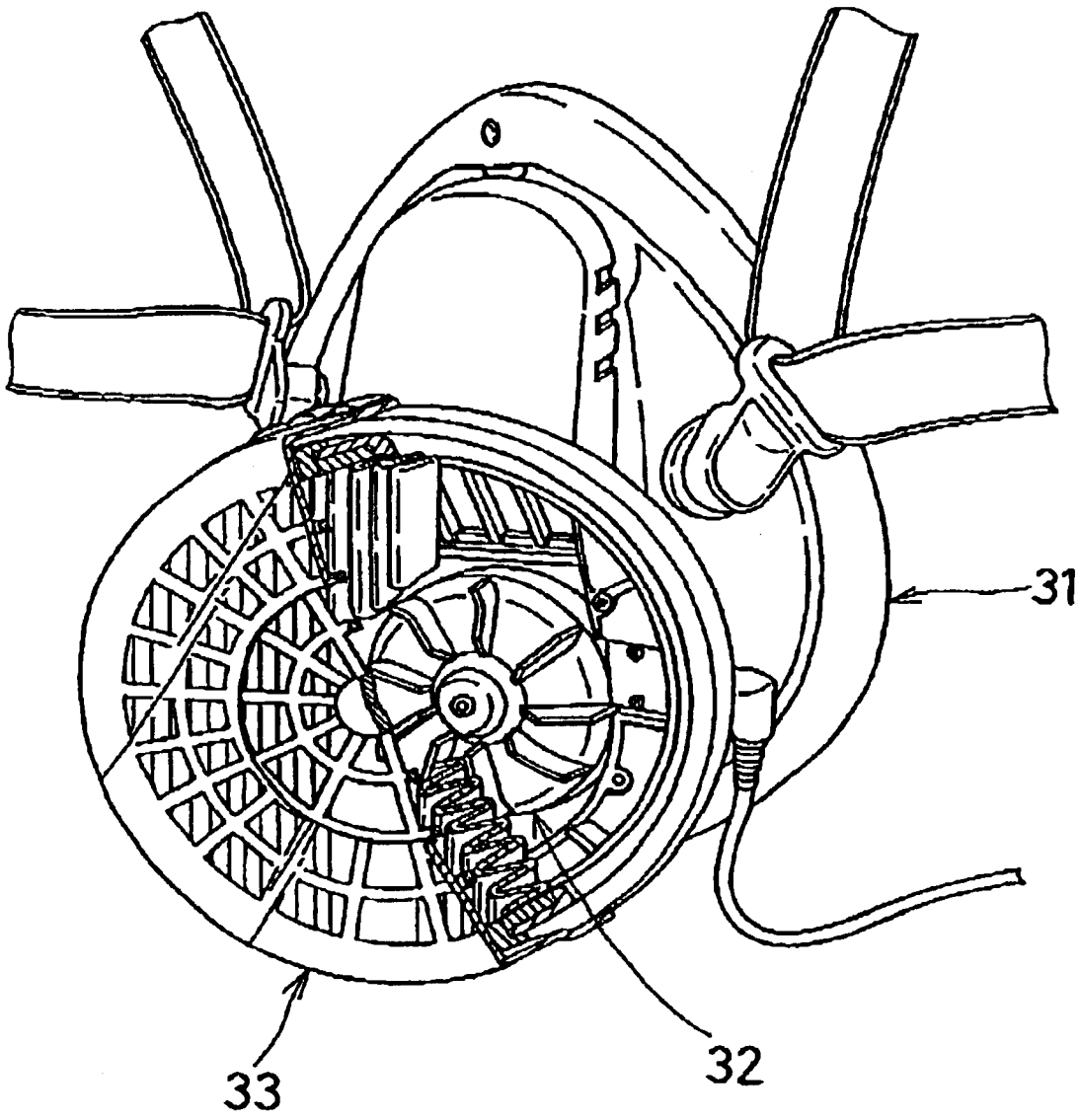
Fig. 4 PRIOR ART
FIG. 4 is a perspective view of a conventional respiratory protection device.
Figure 5:
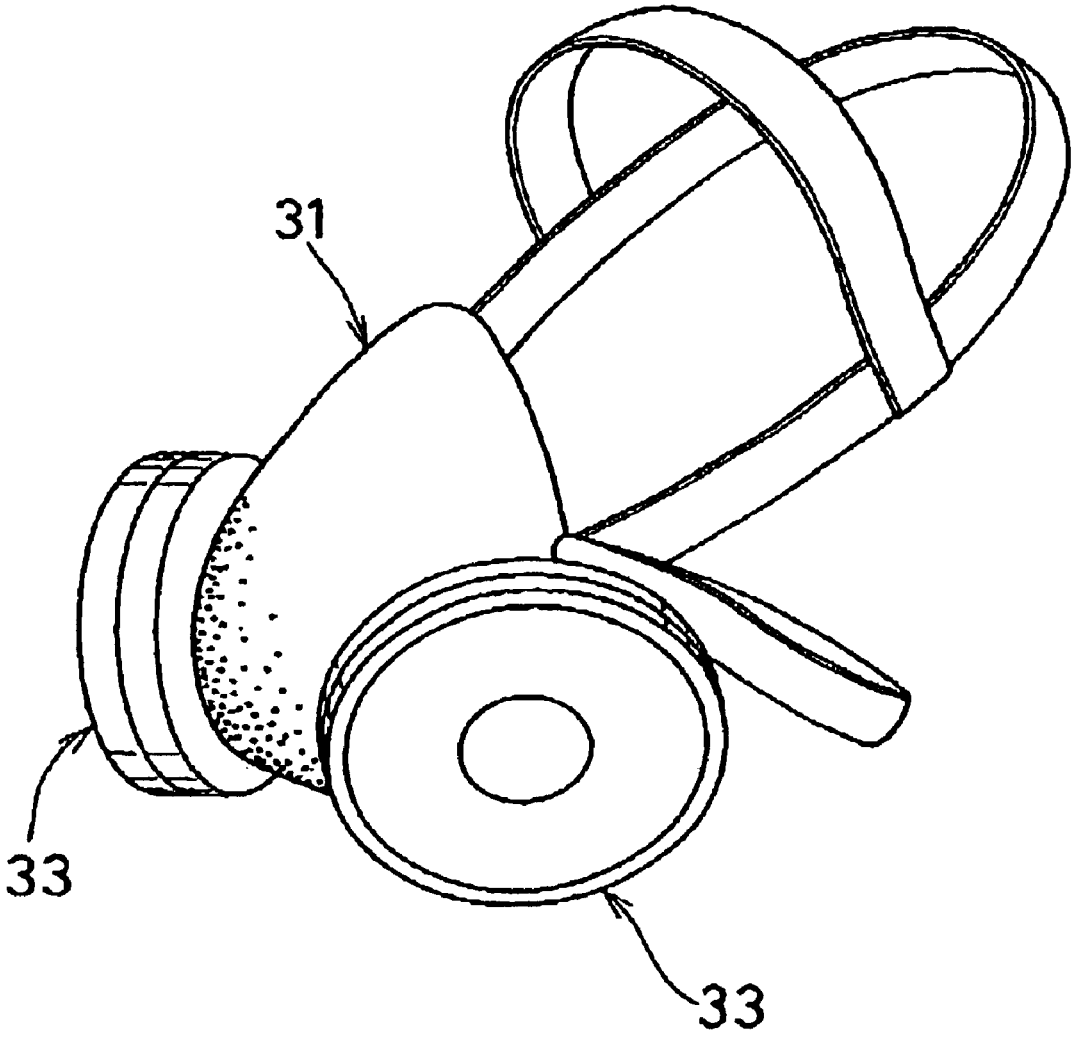
Fig. 5 PRIOR ART
FIG. 5 is a perspective view of another conventional respiratory protection device.

As shown in FIGS. 1 to 3, a respiratory protection apparatus according to the present invention has a face body 1 for covering at least a nose and a mouth of a wearer, a headband 2 for being fit on a head of the wearer and two filtering devices 4, each of which having an electrical fan unit 3. The headband 2 is attached to the both side ends of the face body 1. The filtering devices 4 with the electrical fan units 3 are respectively provided detachably on a left and a right side of a vertical centerline of the face body.

The face body 1 is, for example, made of synthetic resin having flexibility. The face body 1 is provided with a voice transmitter 5 on its upper central portion, an exhaust valve 6 on its lower central portion, and vents 7 for the respective filtering devices 4 on a left and a right side portions of the vertical centerline of the face body. The face body 1 is also provided with a thin wall section 8 which gives cushioning properties to a position with which a nose of a wearer is contacted so as to reduce pressing force on the nose of the wearer when the face body is on the wearer. The face body 1 shown in the drawings has a shape of a half face musk covering a nose and a mouth of a wearer. However, it may be a full face musk covering the entire face of a wearer.

The electrical fan unit 3 has a centrifugal fan 9 and a flat motor 10. Power is supplied from a battery 12 to the flat motor 10 through a power supply cable 11. As the flat motor 10 rotates, then the centrifugal fan 9 attached to the rotation axis of the flat motor 10 also rotates.

The filt ring device 4 includes a filter 13, a holding case 16 and a cover 17. The filter 13 is a cartridge-type, dust prevention and/or gas-proof filter. The holding case 16 has a holding section 14 for holding the filter 13, and therebeneath a receiving recess 15 for the electrical fan unit 3. The cover 17 is for covering the filter 13 in the holding case 16. The electrical fan unit 3 is housed in the receiving recess 15 in the holding case 16. A partition plate 18 is provided between the holding section 14 and the receiving recess 15 to divide them and has a vent 19 at a central portion for ventilating the holding section 14 and the containing space 15. The cover 17 has a vent 20 at its central portion, and is detachably screwed in the holding case 16.

The voice transmitter 5, not shown, is made with conventionally known structure including a front surface frame member, a back frame member and a thin voice transmission film therebetween. The exhaust valve 6, not shown, is also made with conventionally known structure having a check valve or the like.

The face body 1 has vents 7 respectively on a right and a left side portion of the vertical centerline, Each vent 7 has a check valve 21 which, at need, allows air to flow only from the receiving recess 15 toward the face body 1, but prevents its return from the face body 1 to the receiving recess 15. A supporting cylinder 22 is projected surrounding the vent 7, and on the cylindrical end thereof is provided an outward flange 23 which has cutting portions 23*a* at positions facing each other.

The receiving recess 15 in the holding case 16 of the filtering device 4 has a vent 24 leading to the vent 7 of the face body 1. A supporting cylinder 25 is projected surrounding the vent 24, and on the cylindrical end thereof is provided an inward flange 26 which has cutting portions 26*a* at positions facing each other.

On attaching the detachable filtering device 4 to the face body 1, the supporting cylinders 22 protruded surrounding the vents 7 on the left and right side portions of the vertical centerline on the face body 1 are covered and inserted with the supporting cylinder 25 protruded surrounding the vent 24 of the receiving recess 15 in the holding case 16. In this case, the outward flange 23 of the supporting cylinder 22 is put together not to overlap on the inward flange 26 of the supporting cylinder 25. In other words, the outward flange 23 of the supporting cylinder 22 comes into the position of the cutting portions 26*a* of the inward flange 26 of the supporting cylinder 25, while the inward flange 26 of the supporting cylinder 25 comes into the position of the cutting portion 23*a* of the outward flange 23.

Then, by twisting the holding cage 16 in one direction, the outward flange 23 of the supporting cylinder 22 and the inward flange 26 of the supporting cylinder 25 become overlapped, and the supporting cylinders 22 and 25 are bound together and filtering device 4 is attached to the face body 1.

On detaching the filtering device 4 from the face body 1, twisting the holding case 16 it the reverse direction from the above allows the outward flange 23 of the supporting cylinder 22 and the inward flange 26 of the supporting cylinder 25 to shift not to overlap each other, and the above binding state between the supporting cylinders 22 and 25 is released. As a result, the filtering device 4 is detached from the face body 1.

The respiratory protection apparatus according to the present invention has, as described above, the face body 1 and the filtering devices 4 housing the electrical fan units 3 on the left and right side portions of the vertical centerline and they are attached detachably. Therefore, the apparatus enables to have increased air flow rate without enlarging the size of each filtering device 4.

Moreover, the respiratory protection apparatus according to the present invention has the filtering devices 4 housing the electrical fan units 3 on a left and a right side portion of the vertical centerline on the face body, the voice transmitter 5 on an upper central portion of the face body 1, and the exhaust valve 6 on a lower central portion thereof, therefore, the filtering devices 4, the voice transmitter 5 and the exhaust valve 6 are well balanced in the structure.

In addition, in the respiratory protection apparatus, the electrical fan unit 3 may be detached from the face body 1 together with the filtering device 4, when needed Being constructed as stated above, the respiratory protection apparatus according to the present invention enables to ensure air flow rate of more than about 120 liters per minute (required by JIS for a respiratory protection device with an electrically powered fan (JIST8157)), without narrowing the field of front view, without increasing the front side weight, and without deteriorating the work efficiency and/or comfortable fitting. Moreover, since the electrical fan unit may be removed from the face body, the face body is easily washed and cleaned with water, and parts are easily replaced.

What is claimed is:

1. A respiratory protection apparatus comprising a face body, filtering devices which are provided both on a left and a right side portion of a vertical centerline of the face body, an electric fan unit provided in a rear portion of each of the filtering devices a battery provided separate from said filtering devices and an electric cable coupling said battery to each of said electric fan unit and wherein the electrical fan unit has a fan and a motor to which power is supplied from said battery through said cable.

2. A respiratory protection apparatus according to claim 1 wherein each electrical fan unit and each filtering device are respectively provided detachably on the face body.

3. A respiratory protection apparatus according to claim 1 wherein the face body is provided with a voice transmitter on an upper central portion thereof and an exhaust valve on a lower central portion thereof.

4. A respiratory protection apparatus according to claim 2 wherein the face body is provided with a voice transmitter on an upper central portion thereof and an exhaust valve on a lower central portion thereof.

* * * * *